US006122799A

United States Patent [19]

Shimizu et al.

[11] Patent Number: 6,122,799

[45] Date of Patent: Sep. 26, 2000

[54] VACUUM CLEANER WITH THREE STAGE AIR INDUCTION SYSTEM

[75] Inventors: Yuichi Shimizu, Lexington; William R. Tracy, Stanford, both of Ky.

[73] Assignee: Matsushita Electric Corporation of America, Danville, Ky.

[21] Appl. No.: 09/261,372

[22] Filed: Mar. 3, 1999

Related U.S. Application Data

[60] Provisional application No. 60/077,545, Mar. 11, 1998.

[51] Int. Cl.[7] ..... A47L 9/22

[52] U.S. Cl. ..... 15/412; 15/347; 417/423.2; 417/423.14

[58] Field of Search ..... 15/412, 347; 417/423.2, 417/423.14; 415/185, 191, 208.2, 208.3, 208.4

[56] References Cited

U.S. PATENT DOCUMENTS

| | | | |
|---|---|---|---|
| 2,175,641 | 10/1939 | Replogle | 15/412 |
| 2,658,665 | 11/1953 | Tschudy | 417/423.2 |
| 3,263,909 | 8/1966 | Mazepa | 417/423.2 |
| 3,932,070 | 1/1976 | Porter et al. | 417/423.2 |
| 4,808,090 | 2/1989 | Evans | 417/423.2 |
| 4,836,753 | 6/1989 | Berfield et al. | 417/423.2 |
| 5,134,752 | 8/1992 | Shipman | 15/412 |
| 5,296,769 | 3/1994 | Havens et al. | 417/423.2 |
| 5,454,690 | 10/1995 | Wolfe et al. | 417/423.2 |
| 5,477,588 | 12/1995 | Iida et al. | 15/412 |

*Primary Examiner*—Robert J. Warden, Sr.
*Assistant Examiner*—Theresa T. Snider
*Attorney, Agent, or Firm*—King and Schickli PLLC

[57] ABSTRACT

A vacuum cleaner includes a housing, a nozzle for picking up dirt and debris, and a vacuum generator. The vacuum generator includes a motor and drive shaft, a first fan connected to the drive shaft, a shield including a recess that functions as an air induction chamber for receiving the fan, and an air inlet port formed in the shield. A pathway provides fluid communication between the nozzle and the vacuum generator. A dirt and debris collector in the form of a dust bag is provided in the pathway between the nozzle and the vacuum generator. The vacuum cleaner also includes an infuser that is carried on the shield about the air inlet port. The infuser directs air into the induction chamber in a more efficient manner to improve vacuum cleaner performance.

15 Claims, 3 Drawing Sheets

24
22
20
10
14
32
34
18
37
28
16
26
30
42
38
36

VACUUM CLEANER WITH THREE STAGE AIR INDUCTION SYSTEM

This application claims the benefit of U.S. Provisional Patent Application Ser. No. 60/077,545, filed Mar. 11, 1998, entitled "Vacuum Cleaner with Three Stage Air Induction System."

TECHNICAL FIELD

The present invention relates generally to the vacuum cleaner art and, more particularly, to a unique three stage air induction system and a vacuum cleaner incorporating that system.

BACKGROUND OF THE INVENTION

A vacuum cleaner is an electro-mechanical appliance utilized to effect the dry removal of dust, dirt and other small debris from carpets, rugs, fabrics, or other surfaces in both domestic and industrial locations. To achieve the desired dirt and dust removal, a pressure drop, or "vacuum," is used to force air entrained with dirt and dust into the nozzle of the vacuum cleaner. The particulate-laden air is then drawn through a bag-like filter which traps the dirt and dust, while the substantially clean air is exhausted by an electrically operated fan that is driven by an on board motor. It is this fan and motor arrangement that generates the drop in air pressure necessary to provide the desired cleaning action. Thus, the fan and motor arrangement is commonly known as the vacuum generator.

As should be appreciated, the ability of the vacuum generator to efficiently and effectively pull air through the nozzle and create the desired suction is a critical factor in determining the level of cleaning power for the vacuum cleaner. Of course, an important competing factor is to provide this increased suction while keeping the size and energy consumption of the vacuum generator at a minimum. Toward this goal, prior efforts have focused on improving the efficiency of the fan portion of the vacuum generator, such as by utilizing different sizes and shapes of rotating blades and impellers, or increasing the efficiency of the motor itself. Notwithstanding some improvements that have been made over the years, a need still remains in the highly competitive vacuum cleaner market for a vacuum generator that significantly increases the suction power without increasing the size or energy consumption of the motor.

SUMMARY OF THE INVENTION

Accordingly, it is a primary object of the present invention to provide a vacuum cleaner having a vacuum generator that includes a unique air infuser that significantly increases cleaning power and overall performance.

Another object of the present invention is to provide a vacuum cleaner incorporating a vacuum generator that includes a novel infuser that both channels incoming air directly into the fan and reduces the gap between the fan and case or shield to maximize air flow, thereby producing significant increases in suction as defined in inches of water lift.

Still another object of that present invention is to provide a vacuum cleaner having a three stage air induction system which includes a vacuum generator having twin rotating fans and a cooperating fixed infuser for channeling air into the fans.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, a novel air infuser is provided for a vacuum generator that significantly enhances the operating/cleaning efficiency of the vacuum cleaner. In particular, when the air infuser is coupled with an arrangement of fans operating in series, the result is a three stage induction system that advantageously increases the air flow through the vacuum generator, thereby improving the overall cleaning power of the vacuum cleaner.

As is typical, the vacuum cleaner includes a housing. This housing may take the form of either the shell of a canister vacuum cleaner or the body and handle of an upright vacuum cleaner, both of which arrangements are well known in the art. The vacuum cleaner also includes a nozzle to allow the user to direct the vacuum to the desired location for picking up dirt and debris. As is known in the art, the nozzle may be carried by or incorporated integrally into the vacuum cleaner housing of an upright vacuum cleaner. Alternatively, the nozzle may be carried on the end of a wand and hose assembly on an upright or canister vacuum cleaner in a manner well known in the art.

Additionally, the vacuum cleaner includes a vacuum generator. The vacuum generator is mounted in the housing and functions to generate a vacuum that draws air entrained with dirt and debris through the nozzle. The vacuum generator in the preferred embodiment includes a motor and drive shaft, a first fan connected to the drive shaft, a shield defining an air induction chamber for receiving the fan, and an air inlet port formed in the shield.

The vacuum cleaner further includes a pathway providing fluid communication between the nozzle and the vacuum generator. A dirt and debris collector in the form of a dust bag is positioned in the air pathway between the nozzle and the vacuum generator. The dust bag functions to collect and capture entrained dirt and debris from the air for subsequent disposal. The substantially clean air is then drawn through the vacuum generator and exhausted to the environment.

In accordance with an important aspect of the present invention, the vacuum generator incorporates a unique infuser that is carried on the shield about the air inlet and functions to direct air into the induction chamber. Preferably, the infuser includes a first series of spaced vanes for directing air into and through the air inlet. In the most preferred embodiment, the air inlet is substantially circular with upstanding, slightly curved vanes that direct air substantially tangentially into the air inlet. Downstream of the infuser is the first fan, which includes an air intake cavity. The infuser includes an inwardly projecting air guide at least partially projecting into the air intake cavity of the first fan. The first fan is provided with a series of vanes oriented radially about the drive shaft and the air intake cavity. Advantageously, this arrangement of vanes on the infuser and fan together serve to significantly increase the efficiency of the air induction system, which results in a substantial improvement in the cleaning power, efficiency, and overall effectiveness of the vacuum cleaner.

It is also preferred that the vacuum generator includes a second fan connected to the drive shaft to further enhance the air flow through the vacuum cleaner and increase the cleaning power. In such an embodiment, the second fan is positioned downstream of the first fan and is coaxially mounted on the drive shaft. Thus, by virtue of the infuser, the first fan and the second fan acting in series, the air is subjected to three stage induction, which results in the generation of a significantly greater amount of cleaning power for a motor of given size than prior art single or even dual fan designs.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention and together with the description serves to explain the principles of the invention. In the drawing.

Reference will now be made in detail to the present preferred embodiment of the invention, an example of which is illustrated in the accompanying drawing.

DETAILED DESCRIPTION OF THE INVENTION

Figure 1:
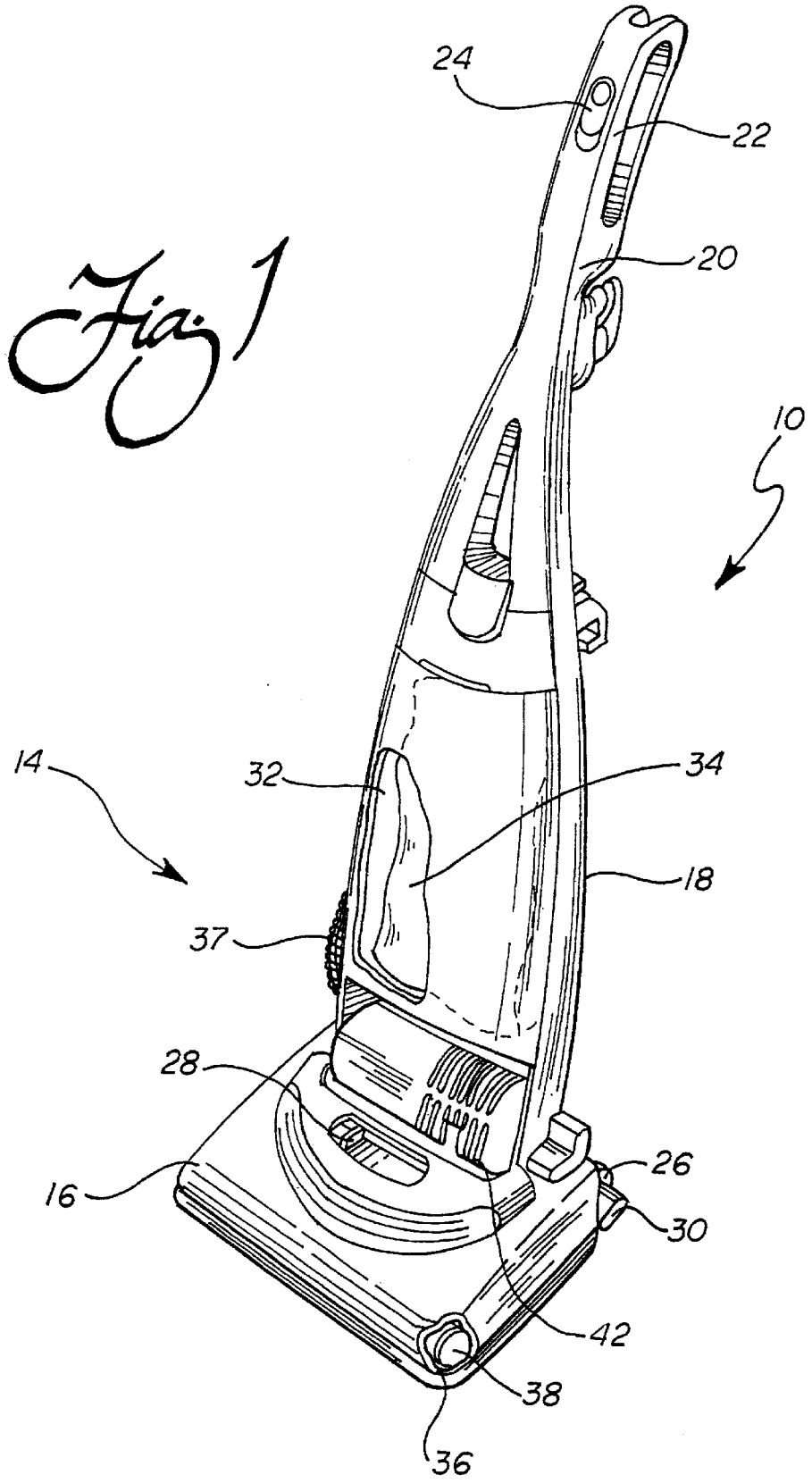
FIG. 1 is a perspective view of an upright vacuum cleaner of the type in which the infuser and three stage air induction system of the present invention is of benefit.
Figure 2:
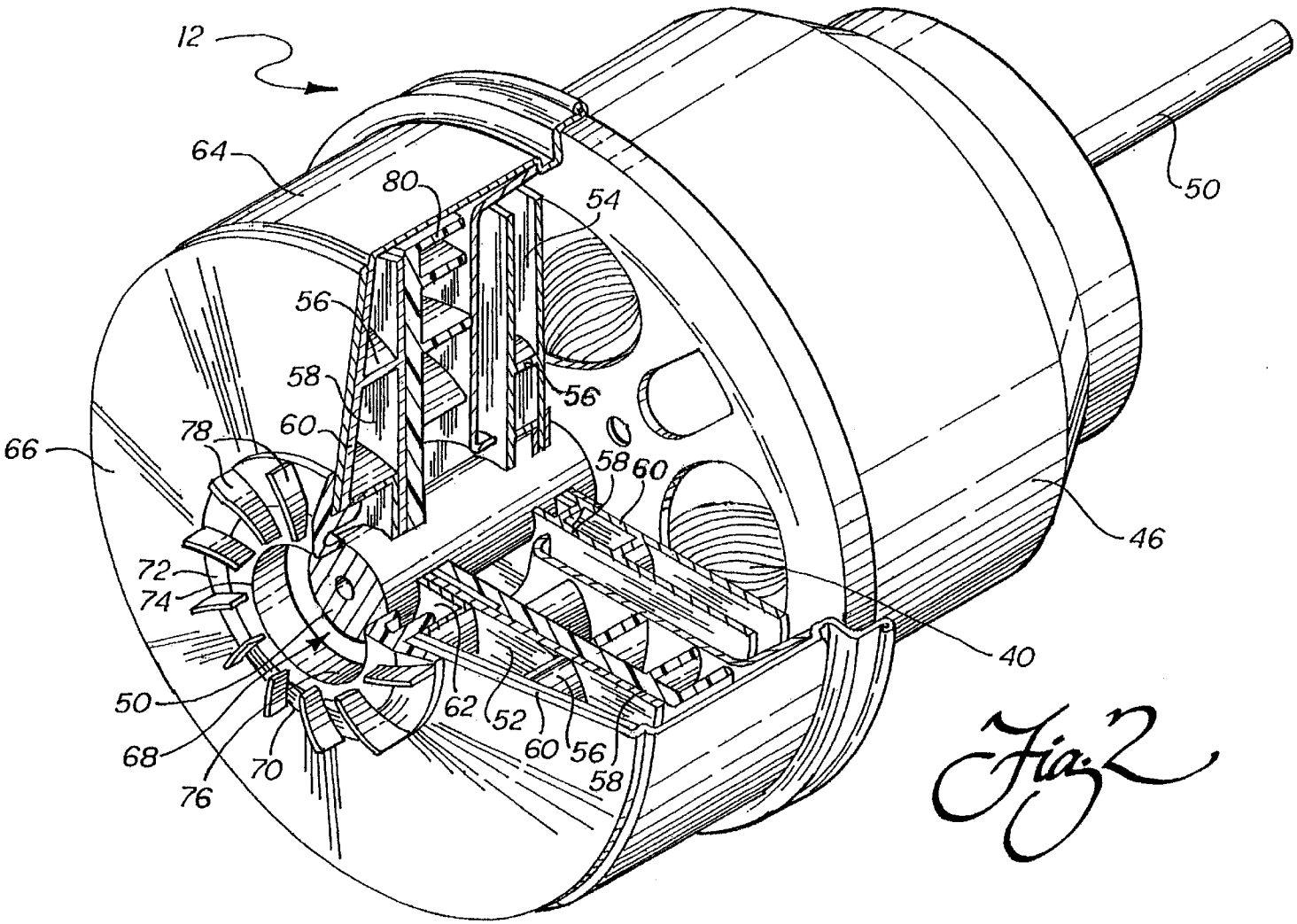
FIG. 2 is a detailed perspective and partially sectional view showing the vacuum generator of the vacuum cleaner incorporating the novel air infuser.

Reference is now made to FIG. 1 showing the vacuum cleaner 10 of the present invention. It should be appreciated that while an upright vacuum 10 is illustrated, canister vacuum cleaners may also utilize and benefit from the novel air induction system 12 of the present invention, as shown in FIG. 2 and described further below.

The overall basic design of the upright vacuum cleaner 10 is generally well known in the art. In the typical arrangement, the upright vacuum cleaner 10 includes a housing 14 that comprises the nozzle assembly 16 and the canister assembly 18, which further includes the handle 20 and the hand grip 22. The hand grip 22 carries a control switch 24 for turning the vacuum cleaner 10 on and off. Of course, electrical power is supplied to the vacuum cleaner 10 through a cord (not shown).

At the lower portion of the canister assembly 18, rear wheels 26 are provided to support the weight of the vacuum cleaner 10. These wheels 26 also provide a pivot point about which the nozzle assembly 16 pivots when adjusted by manipulation of the height adjustment switch 28. To allow for convenient storage of the vacuum cleaner 10, a foot latch 30 functions to lock the canister assembly 18 in an upright position, as shown in FIG. 1. When the foot latch 30 is released, the canister assembly 18 may be pivoted relative to the nozzle assembly 16 as the vacuum cleaner 10 is manipulated to clean the floor. The canister assembly 18 also carries the air induction system 12 for generating a negative pressure or vacuum in an internal chamber 32. The internal chamber 32 houses a dust bag 34 for removing dirt or dust entrained in the air stream as it passes from the nozzle assembly 16 to the air induction system 12.

The nozzle assembly 16 includes a nozzle 36 at its front portion that houses a rotating agitator brush 38. The agitator brush 38 is rotatably driven by the motor 40 of the air induction system 12 (see also FIG. 2). Specifically, the motor 40 includes a drive shaft 50 that is connected to the agitator brush 38 by means of a belt (not shown) in a manner well known in the art. Alternatively, a second, separate motor (not shown) may be provided to drive the agitator brush 38, if desired.

In the illustrated vacuum cleaner 10, the air induction system 12 and the brush 38 cooperate to brush and beat dirt and dust from the nap of the carpet being cleaned and then draw the dirt and dust laden air through a pathway 37 formed by a hose and/or an integrally molded conduit (not shown) in the nozzle assembly 16 and/or canister assembly 18 as is known in the art. The pathway 37 delivers the air entrained with dirt and dust into the chamber 32 and through the porous walls of the dust bag 34. The bag or collector 34 serves to trap the suspended dirt, dust and other particles inside while allowing the now clean air to pass freely through the wall thereof, into the air induction system 12, and ultimately to the environment through the exhaust port 42.

Figure 3:
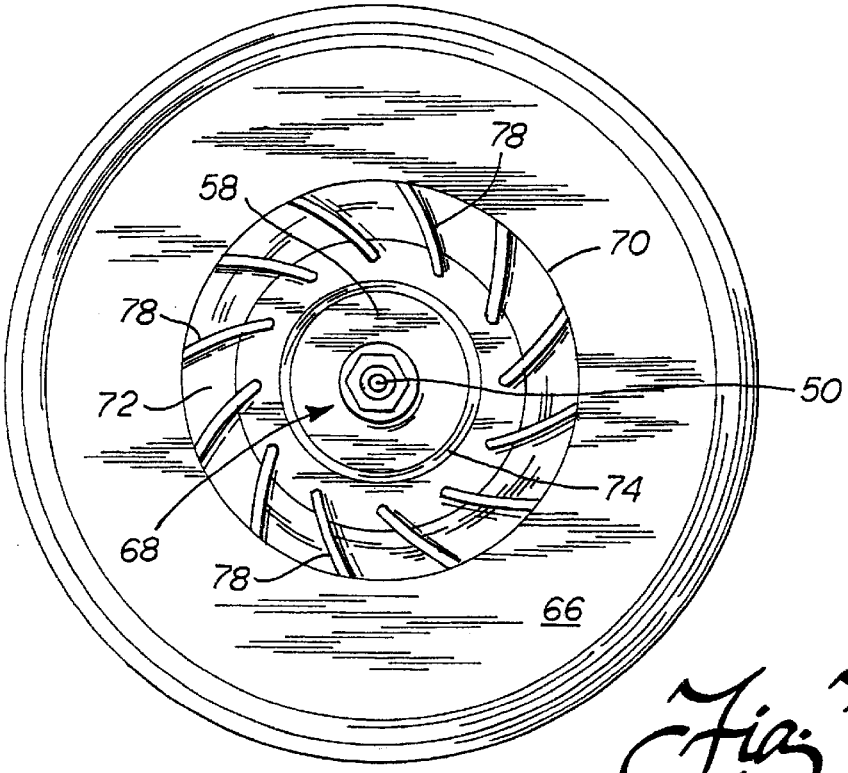
FIG. 3 is an end view showing the relationship of the vanes of the air infuser relative to the air inlet on the shield of the vacuum cleaner.
Figure 4:
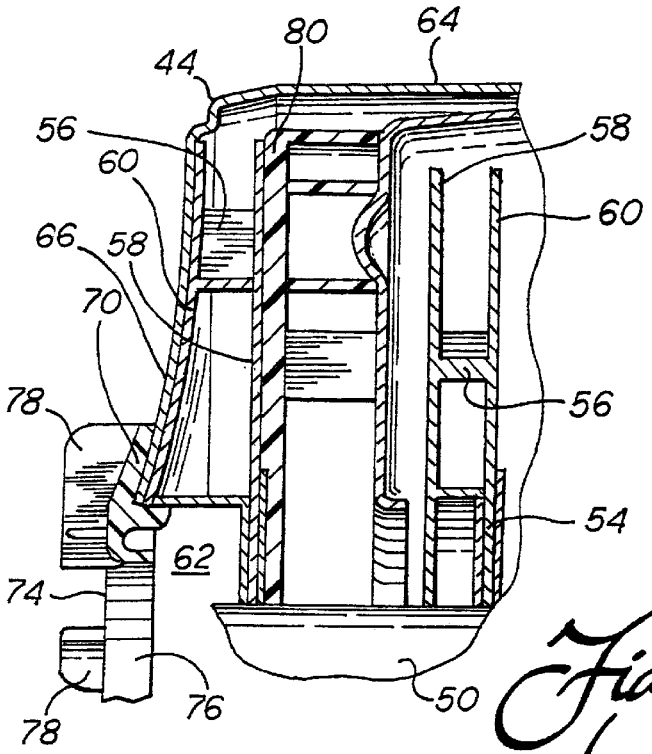
FIG. 4 is a detailed partial cross-sectional view showing the relative structural relationship of the air infuser, shield and fans forming the vacuum generator.

Reference is now made to FIGS. 2, 3 and 4 showing in detail the novel air induction system 12 of the present invention. As best illustrated in FIG. 2, the air induction system 12 includes a shield 44 that is mounted to the housing 46 of the motor 40. The shield 44 is provided with a recess that functions as an air induction chamber 48. The drive shaft 50 extends into the air induction chamber 48 and is rotatably driven by the motor 40. A first fan 52 is keyed or otherwise connected to the drive shaft 50 near the distal end thereof. A second fan 54 is keyed or otherwise connected to the drive shaft 50 a spaced distance from the first fan 52 at an intermediate position between the first fan and the motor 40. Each fan 52, 54 is provided with a series of arcuate vanes 56 that are generally radially disposed about the drive shaft 50. The vanes 56 extend between and engage cooperating spaced annular discs 58, 60 forming the sidewalls of each fan 52, 54. The first fan 52 also includes a central intake cavity 62. The shield 44 includes a generally cylindrical side wall 64 and an end wall 66 incorporating an air inlet port 68. Preferably, the air inlet port 68 is circular and axially aligned with the drive shaft 50.

In accordance with an important aspect of the present invention, an infuser 70 is carried on the shield 44 about the air inlet port 68. The infuser 70 functions to direct air through the inlet port 68 into the induction chamber 48. As best shown in FIGS. 2 and 3, the infuser 70 includes an annular body 72 that defines an inlet throat 74. An air guideway 76 projects from the annular body 72 about the inlet throat 74. As illustrated, the air guideway 76 projects into and is received in the air inlet port 68 of the shield 44. The annular body 72 also carries a series of slightly arcuate vanes 78 that function to direct air substantially tangentially into the inlet throat 74 and through the air inlet port 68 into the central intake cavity 62 of the first fan 52. Thus, it should be appreciated that the relatively fixed infuser 70 functions to channel incoming air directly into the fan 52 to maximize air flow. As a result, more air is pulled into the first fan 52 and fed to the second fan 54, which aids in achieving maximum suction. The enhancement in suction generating efficiency is further maximized through the projection of the air guideway 76 partially into the central intake cavity 62 provided in the first fan 52 (note FIGS. 2 and 4). This arrangement reduces the gap between the fan 52 and the shield 44 and, thus, provides for the smooth channeling of air into the fan. This advantageously avoids the generation of turbulence that would otherwise adversely effect the movement of air and the generation of the desirable enhanced suction that provides the increased cleaning power.

In final analysis, numerous benefits result from employing the concepts of the present invention. The infuser 70, first fan 52 and second fan 54 function in combination to provide a highly efficient three stage air induction system 12 for the vacuum cleaner 10. More particularly, the fixed infuser 70 efficiently and effectively channels incoming air along the vanes 78 through the inlet throat 74 and along the air guideway 76 directly into the central intake cavity 62 of the first fan 52. As a result, the air flows smoothly with a minimum of turbulence and at maximum volume into the first fan 52, wherein the air is drawn through rotation of the vanes 56 over and around the air flow director 80 into the second fan 54. The second fan 54 continues to draw the maximum volume of air through the air induction system 12. As a result of the unique structure and attendant advantages provided by the proposed air induction system 12, the vacuum cleaner 10 achieves at least approximately a 10% increase in performance. This is verified by measuring the maximum suction power in terms of inches of water lift. Of course, increases in air flow and suction result in a concomitant increase in cleaning power. Specifically, more air is available to entrain dirt and debris which is drawn through the nozzle 36 for capture in the dust bag 34. Advantageously, the resulting increase in cleaning efficiency is achieved without increasing the size of the motor 40 or its energy consumption. This is a significant advantage of the three stage air induction system 12 of the present invention.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. A vacuum cleaner, comprising:

a vacuum cleaner housing;

a nozzle for picking up dirt and debris;

a vacuum generator positioned in said vacuum cleaner housing for generating a vacuum to draw air entrained with dirt and debris through said nozzle, said vacuum generator including a motor and drive shaft, a first fan connected to said drive shaft, a shield having a recess forming an air induction chamber which receives said first fan, and an air inlet port formed in said shield;

a pathway providing fluid communication between said nozzle and said vacuum generator; and a dirt and debris collector in said pathway between said nozzle and said vacuum generator;

said vacuum cleaner being characterized by an infuser carried on said shield about said air inlet port for directing air from said pathway into said induction chamber and said first fan.

2. The vacuum cleaner of claim 1, wherein said infuser includes a first series of spaced vanes for directing air into and through said air inlet port.

3. The vacuum cleaner of claim 2, wherein said air inlet port is substantially circular and said vanes direct air substantially tangentially into said air inlet port.

4. A vacuum cleaner, comprising:

a vacuum cleaner housing;

a nozzle for picking up dirt and debris;

a vacuum generator positioned in said vacuum cleaner housing for generating a vacuum to draw air entrained with dirt and debris through said nozzle, said vacuum generator including a motor and drive shaft, first and second fans connected to said drive shaft, a shield having a recess forming an air induction chamber which receives said first and second fans, and an air inlet port formed in said shield;

a pathway providing fluid communication between said nozzle and said vacuum generator;

a dirt and debris collector in said pathway between said nozzle and said vacuum generator; and an infuser carried on said shield about said air inlet port for directing air into said induction chamber, whereby air induction is accomplished in three stages by said infuser, said first fan and said second fan respectively.

5. The vacuum cleaner of claim 4, wherein said infuser includes a first series of spaced vanes for directing air into and through said air inlet port.

6. The vacuum cleaner of claim 5, wherein said air inlet port is substantially circular and said vanes direct air substantially tangentially into said air inlet port.

7. A vacuum generator for use in a vacuum cleaner, comprising:

a motor connected to a drive shaft;

a first fan connected to said drive shaft;

a shield having an air inlet port and a recess forming an air induction chamber which receives said first fan; and an infuser carried on said shield about said air inlet port for directing air into said induction chamber and said first fan.

8. The vacuum generator of claim 7, wherein said infuser includes a first series of spaced vanes for directing air into and through said air inlet port.

9. The vacuum generator of claim 8, wherein said air inlet port is substantially circular and said vanes direct air substantially tangentially into said air inlet port.

10. A vacuum cleaner, comprising:

a vacuum cleaner housing;

a nozzle for picking up dirt and debris;

a vacuum generator positioned in said vacuum cleaner housing for generating a vacuum to draw air entrained with dirt and debris through said nozzle, said vacuum generator including a motor and drive shaft, a first fan connected to said drive shaft, a shield having a recess forming an air induction chamber which receives said first fan, and an air inlet port formed in said shield;

a pathway providing fluid communication between said nozzle and said vacuum generator; and a dirt and debris collector in said pathway between said nozzle and said vacuum generator;

said vacuum cleaner being characterized by an infuser carried on said shield about said air inlet port for directing air from said pathway into said induction chamber and said first fan, said infuser including a first series of spaced vanes and said air inlet port being substantially circular with said first series of vanes directing air substantially tangentially into said air inlet port and wherein said first fan includes a cavity and said infuser includes an inwardly projecting air guide that projects at least partially into said cavity.

11. The vacuum cleaner of claim 10, wherein said first fan includes a second series of vanes oriented generally radially about said drive shaft and said cavity.

12. The vacuum cleaner of claim 11, further including a second fan connected to said drive shaft near said first fan, whereby air induction is accomplished in three stages by said infuser, then said first fan and then said second fan respectively.

13. A vacuum generator for use in a vacuum cleaner, comprising:

a motor connected to a drive shaft;

a first fan connected to said drive shaft;

a shield having an air inlet port and a recess forming an air induction chamber which receives said first fan; and an infuser carried on said shield about said air inlet port for directing air into said induction chamber wherein said infuser includes a first series of spaced vanes and said air inlet port is substantially circular, said first series of vanes directing air substantially tangentially into said air inlet port, and wherein said first fan includes a cavity and said infuser includes an inwardly projecting air guide that projects at least partially into said cavity.

14. The vacuum generator of claim 13, wherein said first fan includes a second series of vanes oriented generally radially about said drive shaft and said cavity.

15. The vacuum generator of claim 14, further including a second fan connected to said drive shaft near said first fan, whereby air induction is accomplished in three stages by said infuser, said first fan and said second fan respectively.

* * * * *